US012442589B2

(12) United States Patent
Rajamanickam et al.

(10) Patent No.: US 12,442,589 B2
(45) Date of Patent: Oct. 14, 2025

(54) REFRIGERATOR APPLIANCE WITH AIRFLOW FEATURES

(71) Applicant: Haier US Appliance Solutions, Inc., Wilmington, DE (US)

(72) Inventors: Saravanan Rajamanickam, Louisville, KY (US); Slawomir Pawel Bolek, Goshen, KY (US); David Gantt, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 260 days.

(21) Appl. No.: 18/303,996

(22) Filed: Apr. 20, 2023

(65) Prior Publication Data

US 2024/0353169 A1 Oct. 24, 2024

(51) Int. Cl.
*F25D 23/04* (2006.01)
*F25D 17/06* (2006.01)

(52) U.S. Cl.
CPC ..... *F25D 23/04* (2013.01); *F25D 17/062* (2013.01); *F25D 2317/067* (2013.01)

(58) Field of Classification Search
CPC .. F25D 23/04; F25D 17/062; F25D 2317/067; F25D 2317/063; F25D 27/00; F25D 2317/061; F25D 2317/0665
See application file for complete search history.

(56) References Cited

U.S. PATENT DOCUMENTS

| | | | |
|---|---|---|---|
| 10,634,418 | B2 | 4/2020 | Bae et al. |
| 10,976,091 | B2 | 4/2021 | Kim |
| 11,402,146 | B2 | 8/2022 | Jeon et al. |
| 2019/0145686 | A1 | 5/2019 | Kim |
| 2019/0277557 | A1 | 9/2019 | Khekale |
| 2021/0095910 | A1 | 4/2021 | Jeon et al. |
| 2021/0199364 | A1 | 7/2021 | Kim |

FOREIGN PATENT DOCUMENTS

| | | | |
|---|---|---|---|
| JP | H09210531 | A | 8/1997 |
| JP | 3389400 | B2 | 3/2003 |
| WO | WO2017190807 | A1 | 11/2017 |
| WO | WO2021187742 | A1 | 9/2021 |

*Primary Examiner* — Cassey D Bauer
(74) *Attorney, Agent, or Firm* — Dority & Manning, P.A.

(57) ABSTRACT

A refrigerator appliance includes a cabinet defining a food storage chamber. The food storage chamber extends between a front side and a back side in a first direction and between a floor and a ceiling in a second direction. The refrigerator appliance also includes a storage element positioned at the front side of the food storage chamber. An air flow path for chilled air to the storage element may be at least partially defined by a front portion of the ceiling, a back portion of the ceiling, and/or an external surface of a light fixture.

17 Claims, 6 Drawing Sheets

REFRIGERATOR APPLIANCE WITH AIRFLOW FEATURES

FIELD OF THE INVENTION

The subject matter of the present disclosure relates generally to refrigerator appliances and more particularly to air flow paths within and through such appliances for distribution of chilled air.

BACKGROUND OF THE INVENTION

Refrigerator appliances generally include a cabinet that defines one or more chilled chambers for receipt of food items for storage. One or more insulated, sealing doors are provided for selectively enclosing the chilled food storage chamber(s). Generally, the door(s) are movable between a closed position and an open position for accessing food items stored therein by pulling on the door(s), such as by pulling on a handle on the door.

Typical refrigerator appliances include one or more storage elements in the chilled chamber, such as bins, shelves, baskets, sub-compartments, and other storage elements. In some instances, the storage element or elements may be positioned remote from a chilled air source, such as remote from an inlet from a mechanical compartment of the refrigerator appliance through which chilled air from an evaporator enters the chilled chamber. The refrigerator appliance may include ducts, channels or other enclosed conduits to convey the chilled air to one or more storage elements, such as storage elements that are remote from the point of ingress for chilled air into the chilled chamber. However, such structures may add bulk to the refrigerator appliance, such as may impinge on or reduce the available space within the cabinet for the volume of the chilled chamber. Additionally, such structures may detract from the aesthetics of the refrigerator appliance, e.g., when the structures and outlets thereof are visible within the chilled chamber.

Accordingly, a refrigerator having an improved means for providing an air flow path therein is desired in the art.

BRIEF DESCRIPTION OF THE INVENTION

Aspects and advantages of the invention will be set forth in part in the following description, or may be apparent from the description, or may be learned through practice of the invention.

In one exemplary embodiment, a refrigerator appliance is provided. The refrigerator appliance defines a vertical direction, a lateral direction, and a transverse direction. The vertical, lateral, and transverse directions are mutually perpendicular. The refrigerator appliance includes a cabinet defining a food storage chamber. The food storage chamber extends between a front side and a back side along the transverse direction. The food storage chamber extends between a floor and a ceiling along the vertical direction. The front side of the food storage chamber defines an opening for receipt of food items. The refrigerator appliance also includes a door positioned at the front side of the food storage chamber. The door is movable between a closed position and an open position to selectively sealingly enclose the food storage chamber in the closed position and provide access to the food storage chamber through the opening in the open position. The refrigerator appliance further includes a storage element positioned at the front side of the food storage chamber such that the storage element is positioned at the front side of the food storage chamber when the door is in the closed position. The ceiling of the food storage chamber includes a front portion, and the front portion of the ceiling of the food storage chamber is angled downward towards the storage element. The ceiling of the food storage chamber thus at least partially defines an air flow path for chilled air to the storage element.

In another exemplary embodiment, a refrigerator appliance is provided. The refrigerator appliance defines a vertical direction, a lateral direction, and a transverse direction. The vertical, lateral, and transverse directions are mutually perpendicular. The refrigerator appliance includes a cabinet defining a food storage chamber. The food storage chamber extends between a front side and a back side along the transverse direction. The food storage chamber extends between a floor and a ceiling along the vertical direction. The front side of the food storage chamber defines an opening for receipt of food items. The refrigerator appliance also includes a door positioned at the front side of the food storage chamber. The door is movable between a closed position and an open position to selectively sealingly enclose the food storage chamber in the closed position and provide access to the food storage chamber through the opening in the open position. The refrigerator appliance also includes a storage element mounted on an interior surface of the door such that the storage element is positioned at the front side of the food storage chamber when the door is in the closed position. The ceiling of the food storage chamber includes a back portion. The back portion of the ceiling of the food storage chamber extends from the back side of the food storage chamber to a peak of the ceiling. The ceiling of the food storage chamber thus at least partially defines an air flow path for chilled air to the storage element.

In still another exemplary embodiment, a refrigerator appliance is provided. The refrigerator appliance defines a vertical direction, a lateral direction, and a transverse direction. The vertical, lateral, and transverse directions are mutually perpendicular. The refrigerator appliance includes a cabinet defining a food storage chamber. The food storage chamber extends between a front side and a back side along the transverse direction. The food storage chamber extends between a floor and a ceiling along the vertical direction. The front side of the food storage chamber defines an opening for receipt of food items. The refrigerator appliance also includes a door positioned at the front side of the food storage chamber. The door is movable between a closed position and an open position to selectively sealingly enclose the food storage chamber in the closed position and provide access to the food storage chamber through the opening in the open position. The refrigerator appliance also includes a storage element mounted on an interior surface of the door such that the storage element is positioned at the front side of the food storage chamber when the door is in the closed position. The refrigerator appliance further includes a light fixture positioned above the ceiling of the food storage chamber. An external surface of the light fixture is mounted flush with the ceiling, such that the external surface of the light fixture at least partially defines an air flow path for chilled air to the storage element.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
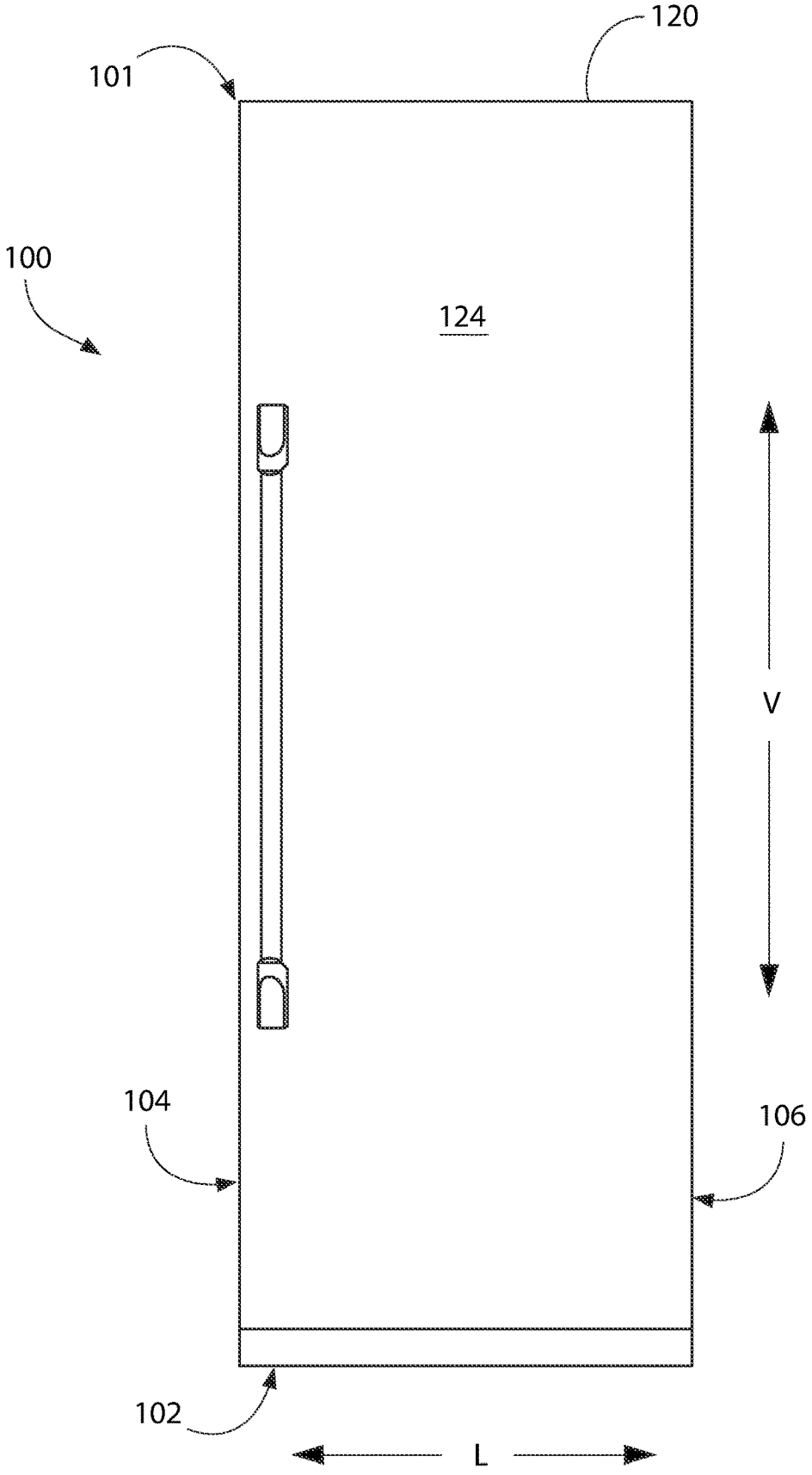
FIG. 1 provides a front elevation view of a refrigerator appliance according to an exemplary embodiment of the present subject matter with a door of the refrigerator appliance shown in the closed position.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. The detailed description uses numerical and letter designations to refer to features in the drawings. Like or similar designations in the drawings and description have been used to refer to like or similar parts of the disclosure. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. Terms such as "left," "right," "front," "back," "top," or "bottom" are used with reference to the perspective of a user accessing the refrigerator appliance. For example, a user stands in front of the refrigerator to open the door(s) and reaches into the food storage chamber(s) to access items therein.

As used herein, terms of approximation, such as "approximately," "generally," or "about" include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counterclockwise.

Figure 2:
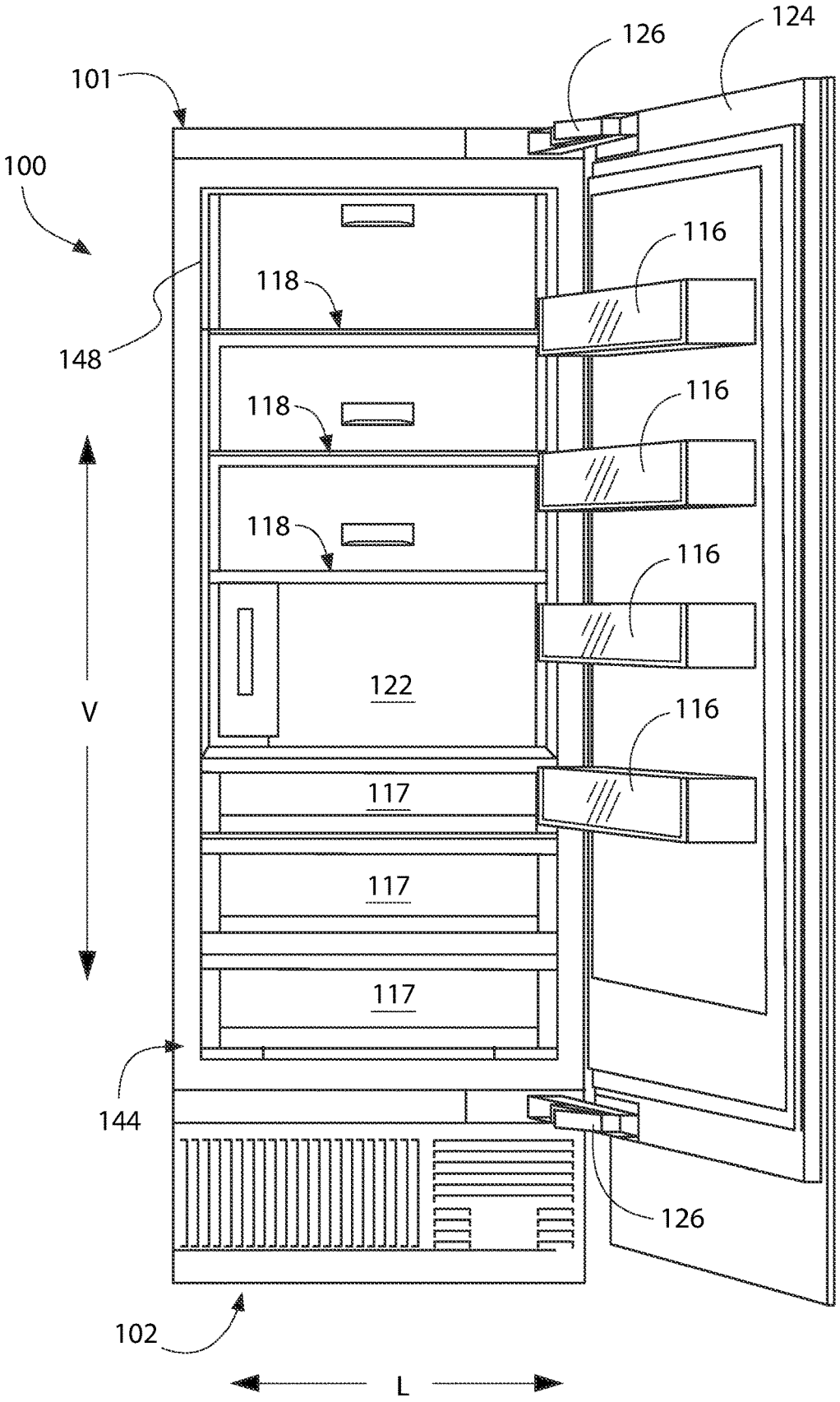
FIG. 2 provides a front elevation view of the exemplary refrigerator appliance of FIG. 1 with the door shown in an open position.
Figure 3:
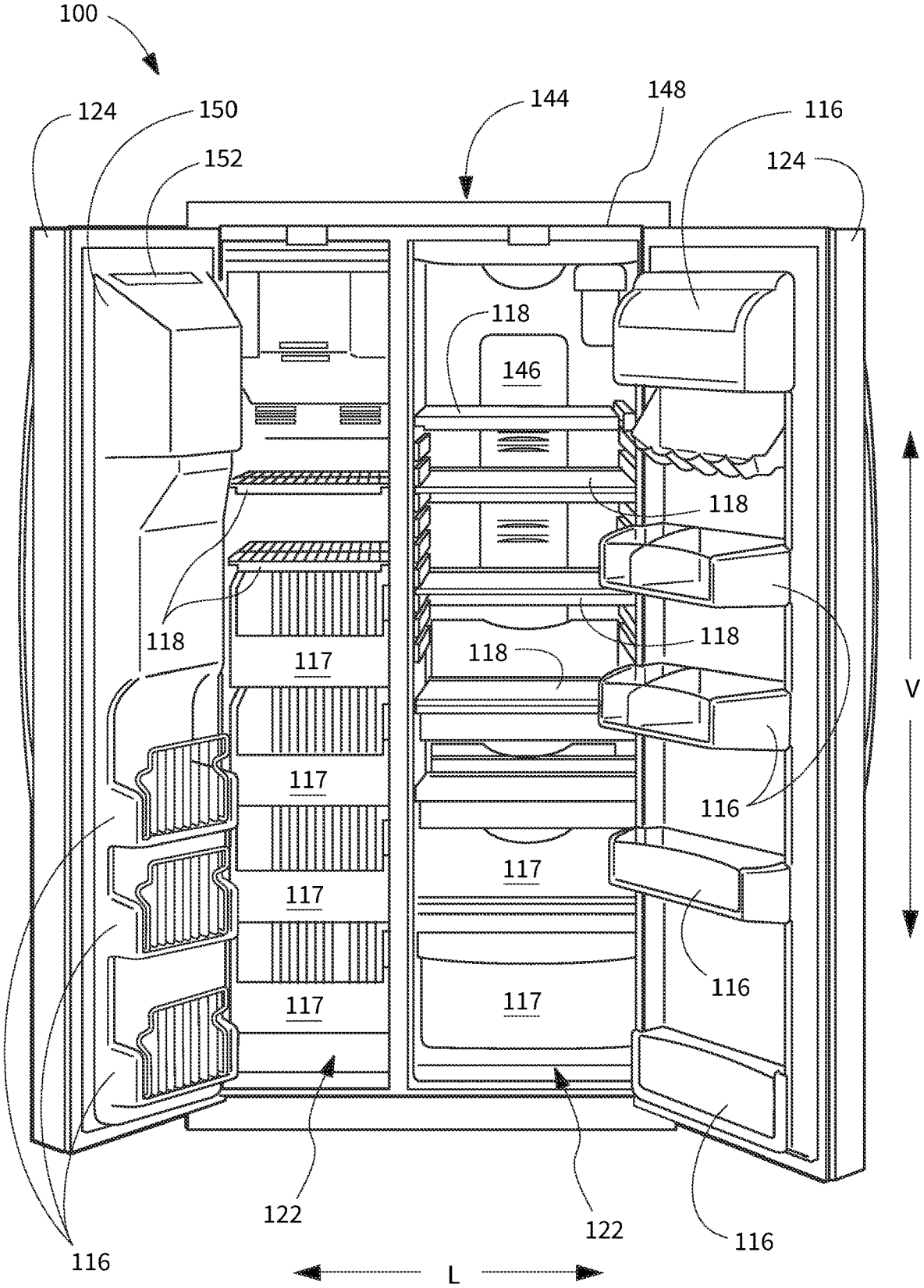
FIG. 3 provides a front elevation view of a refrigerator appliance according to another exemplary embodiment of the present subject matter.

As illustrated in FIGS. 1 through 5, an exemplary refrigerator appliance 100 has an insulated housing or cabinet 120 that defines at least one food storage chamber 122. A door 124 is provided to selectively sealingly enclose the food storage chamber 122 when in a closed position (FIG. 1) and provide access to the food storage chamber 122 when in an open position (FIG. 2 or FIG. 3). The door 124 is rotatably mounted to the cabinet 120, such as by one or more hinges 126 (FIG. 2), to rotate between the open position and the closed position. Embodiments where more than one food storage chamber 122 is provided may include an equal number of doors 124 as food storage chambers 122, e.g., each door provided to selectively sealingly enclose one corresponding food storage chamber 122 when in the closed position. In some embodiments, more than one door may be provided for a single chilled chamber, such as two doors in a French door configuration for a single fresh food storage chamber (which may or may not be the only chilled chamber in the refrigerator appliance according to various embodiments of the present disclosure).

Refrigerator appliance 100 defines a vertical direction V, a lateral direction L, and a transverse direction T (FIG. 5), each mutually perpendicular to one another. As may be seen in FIGS. 1 through 5, the cabinet or housing 120 extends between a top 101 and a bottom 102 along the vertical direction V, between a left side 104 and a right side 106 along the lateral direction L, and between a front side 108 (FIG. 5) and a rear side 110 (FIG. 5) along the transverse direction T. As may be seen in FIGS. 3 and 5, the food storage chamber 122 extends between a front side 144 and a back side 146 along the transverse direction T. The front side 144 of the food storage chamber 122 defines an opening 148 for receipt of food items. The food storage chamber 122 is a chilled chamber 122 for receipt of food items for storage. As used herein, the chamber may be "chilled" in that the chamber is operable at temperatures below room temperature, e.g., less than about seventy-five degrees Fahrenheit (75° F.). One of ordinary skill in the art will recognize that the food storage chamber 122 may be chilled by a sealed refrigeration system, such that the food storage chamber 122 may be operable at or about the temperatures described herein by providing chilled air from the sealed system. The structure and function of such sealed systems are understood by those of ordinary skill in the art and, as such, are not described in complete detail herein for the sake of brevity and clarity.

Refrigerator door 124 is rotatably mounted, e.g., hinged, to an edge of cabinet 120 for selectively accessing the fresh food storage chamber 122 within the cabinet 120. Refrigerator door 124 may be mounted to the cabinet 120 at or near the front side 144 of the food storage chamber 122 such that the door 124 moves, e.g., rotates via hinges 126 (FIG. 2), between the closed position (FIG. 1) and the open position (FIGS. 2 and 3). In the closed position of FIG. 1, the door 124 sealingly encloses the food storage chamber 122. Additionally, one or more gaskets and other sealing devices, which are not shown but will be understood by one of ordinary skill in the art, may be provided to promote sealing between the door 124 and the cabinet 120. In the open position of FIGS. 2 and 3, the door 124 permits access to the fresh food storage chamber 122, e.g., through the opening 148.

As shown for example in FIGS. 2 and 3, various storage components may be mounted within the food storage chamber 122 to facilitate storage of food items therein as will be understood by those skilled in the art. In particular, the storage components include bins 116, drawers 117, and shelves 118 that are mounted within fresh food chamber 122. Bins 116, drawers 117, and shelves 118 are configured for receipt of food items (e.g., beverages and/or solid food items) and may assist with organizing such food items.

As depicted in FIGS. 1 and 2, cabinet 120 defines a single chilled chamber 122 for receipt of food items for storage. In the example embodiment illustrated in FIGS. 1 and 2, the single chilled chamber 122 is a fresh food chamber 122, e.g., which may be operable within a temperature range above the freezing point of water and below room temperature, such as between approximately thirty-three degrees Fahrenheit (33° F.) and approximately sixty degrees Fahrenheit (60° F.). In some embodiments, the chilled chamber may be a freezer chamber, e.g., may be operable within a temperature range including temperatures below the freezing point of water, e.g., less than thirty-two degrees Fahrenheit (32° F.), such as between approximately thirty degrees Fahrenheit (30° F.) and approximately zero degrees Fahrenheit (0° F.), and/or the refrigerator appliance 100 may include one or more additional chilled chambers for receipt of various food items and storage of such items at various temperatures as desired. For example, in embodiments where the chilled chamber 122 is a fresh food storage chamber, the chilled chamber may be operable at a temperature of about forty degrees Fahrenheit (40° F.) or about forty-five degrees Fahrenheit (45° F.), and in embodiments where the chilled chamber 122 is a freezer chamber, the chilled chamber may be operable at a temperature of about zero degrees Fahrenheit (0° F.), or about fifteen degrees Fahrenheit (15° F.) or about twenty-five degrees Fahrenheit (25° F.). For example, the refrigerator appliance 100 may include one or more chilled chambers configured for deep freeze (e.g., at about 0° F. or less, such as between about 0° F. and about −15° F.) storage, or configured for chilling certain items, e.g., produce or wine, at relatively warmer temperatures such as about 60° F. or more (while still below room temperature, as noted above), as well as any suitable temperatures between the stated examples. In various exemplary embodiments, the chilled chamber 122 may be selectively operable at any number of various temperatures and/or temperature ranges as desired or required per application, and/or the refrigerator appliance 100 may include one or more additional chambers selectively operable at any suitable food storage temperature.

The illustrated exemplary refrigerator appliance 100 in FIGS. 1 and 2 is generally referred to as a single-door or single-purpose refrigerator, sometimes also referred to as a column refrigerator. It is recognized, however, that the benefits of the present disclosure apply to other types and styles of refrigerators such as, for example, a bottom mount refrigerator, a top mount refrigerator, a side-by-side style refrigerator (e.g., as illustrated in FIG. 3), or a freezer appliance. Consequently, the description set forth herein is for illustrative purposes only and is not intended to be limiting in any aspect to a particular refrigerator chamber configuration.

As illustrated for example in FIG. 3, in some embodiments the refrigerator appliance 100 includes multiple chilled chambers 122 include a side-by-side style, which includes a fresh food storage chamber next to, e.g., beside, a freezer chamber. Such embodiments may include a first chilled chamber 122 (e.g., on the left in FIG. 3) which is a freezer chamber, and a second chilled chamber 122 (e.g., on the right in FIG. 3) which is a fresh food storage chamber. In embodiments where the chilled chamber 122—or one of the chilled chambers 122, if multiple chilled chambers 122 are provided—is a freezer chamber, an ice box 150 may be provided in the freezer chamber, such as on an interior side of the corresponding door 124 of the refrigerator appliance 100, whereby the ice box 150 is inside the freezer chamber 122 at least when the door 124 is in the closed position. The ice box 150 may include an inlet 152 by which freezer air (e.g., chilled air C as illustrated in FIGS. 5 and 6 and described in further detail below) flows into the ice box 150.

Figure 4:
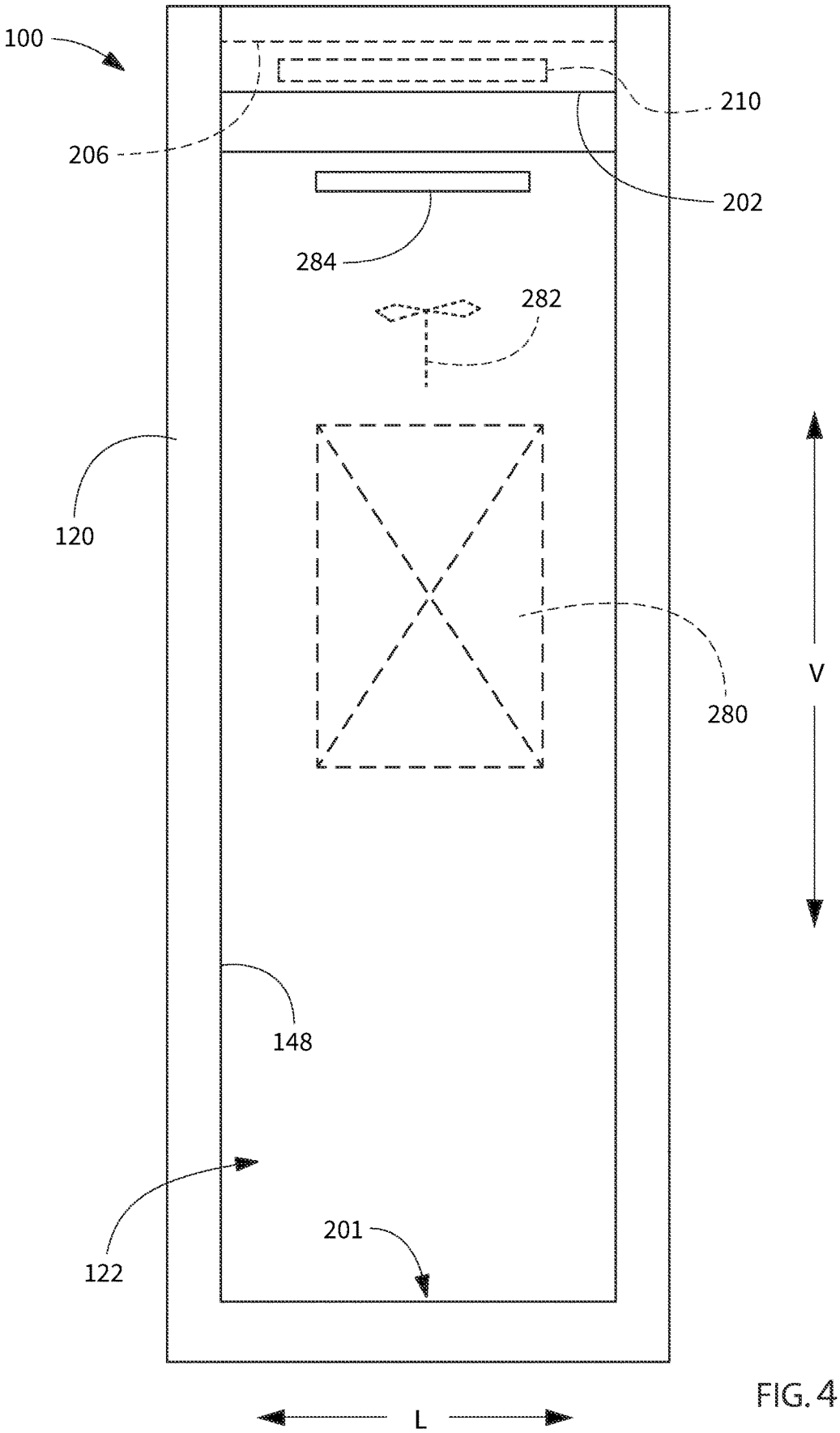
FIG. 4 provides a front view of a chilled chamber of a refrigerator appliance such as the exemplary refrigerator appliances of FIGS. 1-3.

FIG. 4 provides a front view of a cabinet 120 (or portion of a cabinet in some embodiments, e.g., embodiments where more than one chilled chamber 122 is provided) with a door not shown in order to more clearly depict internal portions of the food storage chamber 122. As may be seen, e.g., in FIG. 4, the present disclosure provides an aesthetically clean edge when looking into the food storage chamber 122 from the front, e.g., as in the view generally depicted in FIG. 4. For example, a front edge 202 of a ceiling 200 of the food storage chamber 122 may be visible without any visible ducts, grilles, etc., or other air flow structures. The food storage chamber 122 may be defined, e.g., along the vertical direction V, by and between the ceiling 200 and a floor 201.

As mentioned, the food storage chamber 122 may be chilled by a sealed refrigeration system, the overall structure and operation of which are well understood by those of ordinary skill in the art. The sealed cooling system or sealed refrigeration system may include a plurality of heat exchangers, e.g., at least one condenser and at least one evaporator. For example, evaporator 280 may be a part of the sealed refrigeration system, e.g., may be a fresh food evaporator, a freezer evaporator, or may be the only evaporator in the refrigerator appliance 100, such as in embodiments where the refrigerator appliance 100 is a single-door or single-purpose refrigerator.

Figure 5:
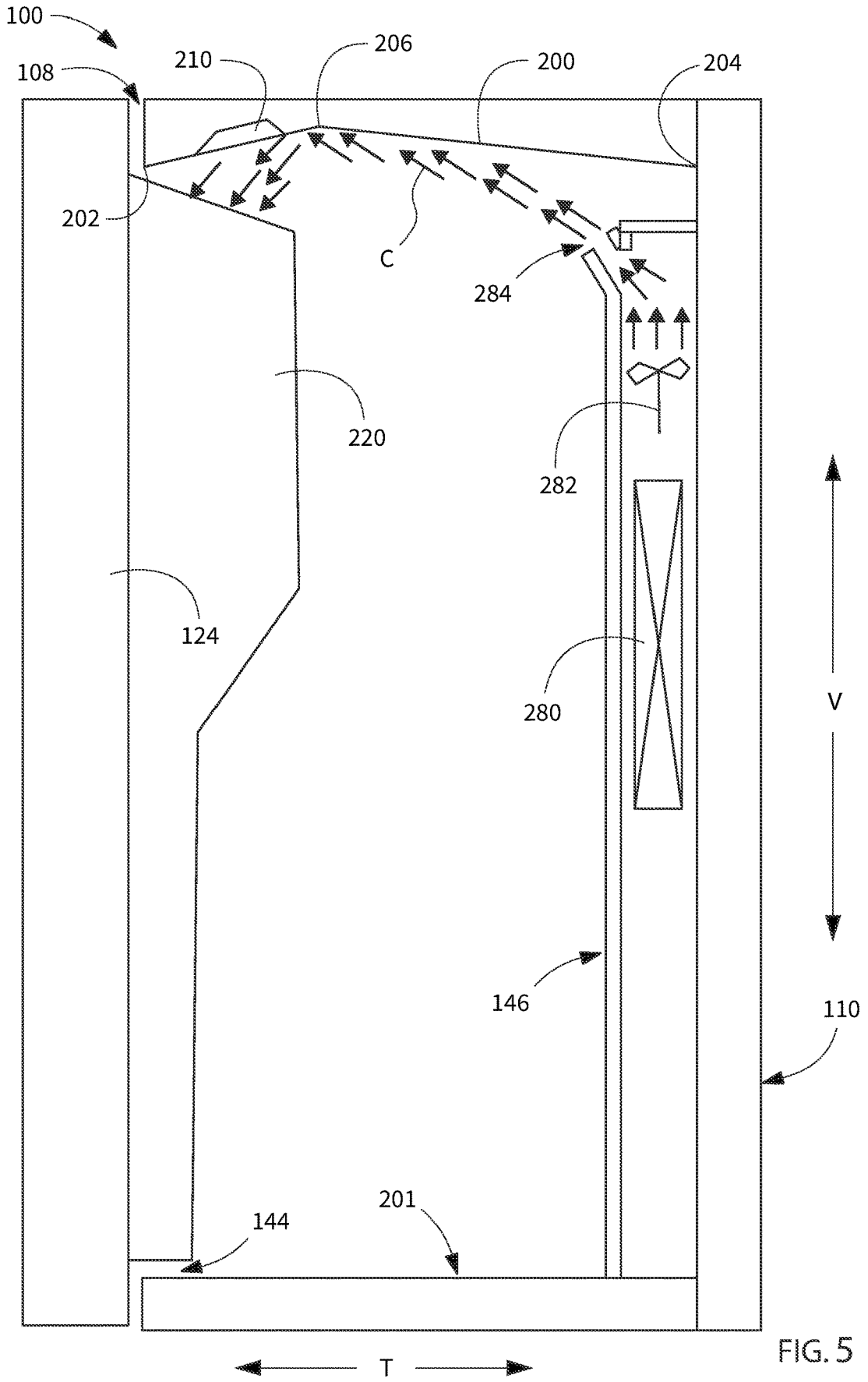
FIG. 5 provides a cross-sectional view of the chilled chamber of FIG. 4.
Figure 6:
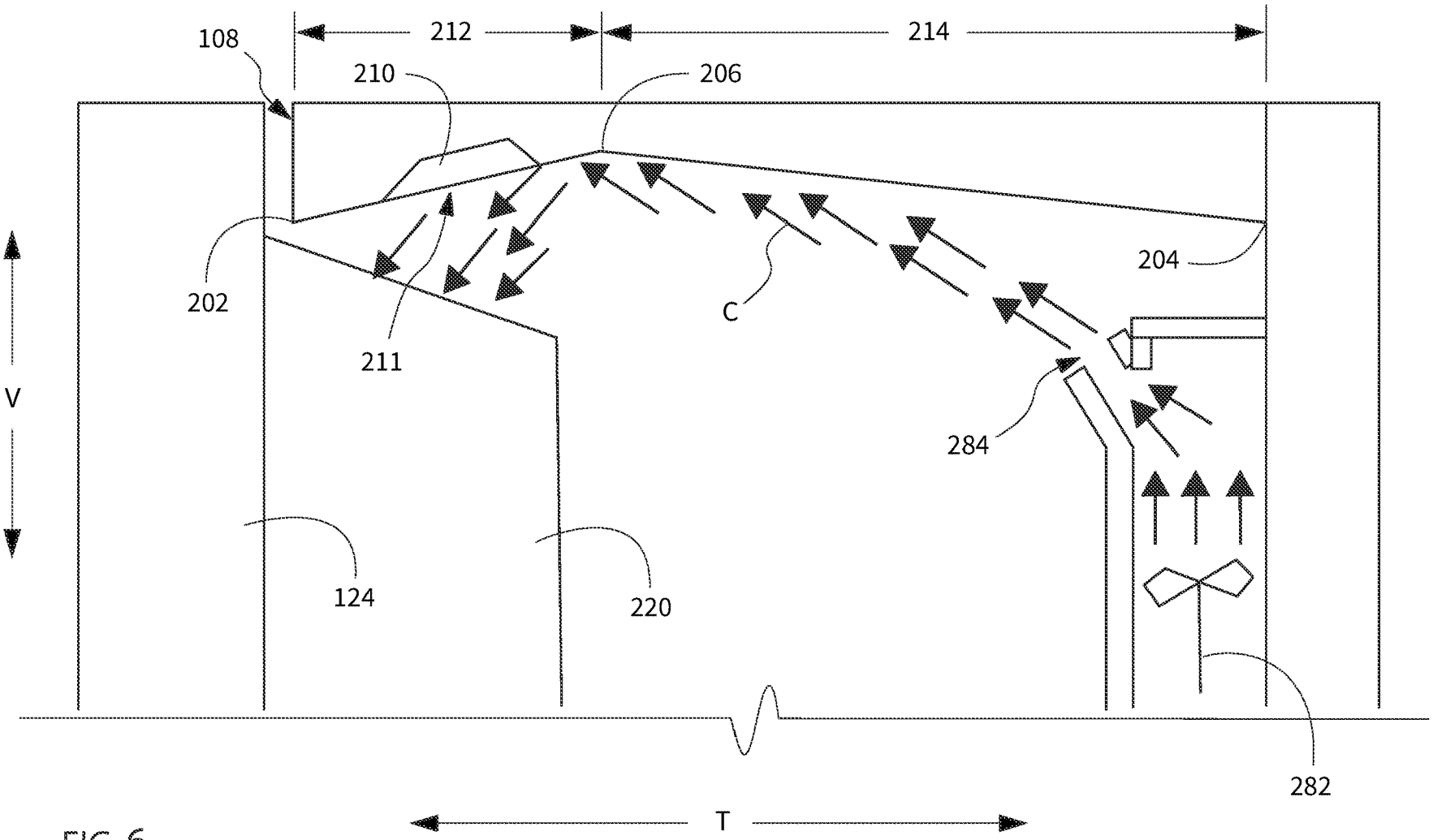
FIG. 6 provides an enlarged view of a portion of the chilled chamber of FIG. 5.

As illustrated in FIGS. 4 and 5, the evaporator 280 may be positioned at the back side 146 of the food storage chamber 122 and upstream of a vent 284, such as upstream of the vent 284 along a flow of chilled air C which is urged from the evaporator 280 into the food storage chamber 122 through the vent 284 by an air handler, e.g., fan, 282. The air flow path for chilled air C to the storage element 220 may originate at the evaporator 280 and may enter the food storage chamber 122 through the vent 284.

In some embodiments, e.g., as illustrated in FIGS. 5 and 6, the refrigerator appliance 100 may include a storage element 220 positioned at the front side 108 of the cabinet 120 and/or the front side 144 of the food storage chamber 122. For example, the storage element 220 may be positioned, e.g., mounted, on an interior surface of the door 124, e.g., as illustrated in FIGS. 5 and 6. The storage element 220 may be any one of the exemplary storage elements described above, such as a bin 116, shelf 118, or drawer 117. In some embodiments, e.g., where the food storage chamber 122 is a freezer chamber, the storage element 220 may be an ice box such as ice box 150 illustrated in FIG. 3. The chilled air C may be directed to the storage element 220, such as into and through the open top of a bin 116 (see, e.g., FIG. 3), or into the ice box 150 through the inlet 152. For example, the chilled air C may be directed to or towards the ceiling 200, e.g., by the fan 282 and/or vent 284, and the ceiling 200 may guide the chilled air C to the storage element 220.

The ceiling 200 of the food storage chamber 122 may extend from a front edge 202, e.g., which is positioned at the front side 108 of the cabinet 120 and/or at the front side 144 of the food storage chamber 122, and the front edge 202 of the ceiling 200 may define an upper boundary of the opening 148 (FIG. 4). The ceiling 200 may extend from the front edge 202 into the food storage chamber 122, such as upwards along the vertical direction V and inwards along the transverse direction T. For example, the ceiling 200 may extend up and in at an oblique angle from the front edge 202 to an inflection point or peak 206 of the ceiling 200. The portion of the ceiling 200 from the front edge 202 to the peak 206, and including the front edge 202 and the peak 206, may define a front portion 212 (FIG. 6) of the ceiling 200. The front portion 212 of the ceiling 200 may at least partially define the flow path for chilled air C to the storage element 220, such as the front portion 212 may define a flow path or portion thereof which is angled downward towards the storage element 220, such as downwards towards the storage element 220 in the flow direction of the chilled air C as urged by the fan 282. In some embodiments, the front portion 212 of the ceiling 200 may begin at the peak 206 of the ceiling and the front portion 212 of the ceiling 200 may extend frontward and downward along the flow direction of chilled air C from the peak 206 of the ceiling 200.

In some embodiments, the vent 284 may be oriented towards the ceiling 200. In such embodiments, the vent 284 may be oriented generally upwards along the vertical direction V, such as upwards with respect to the vertical direction V and forward with respect to the transverse direction T. For example, the vent 284 may be oriented towards the ceiling 200 at an oblique angle to the vertical direction V.

In some embodiments, the evaporator 280 may be positioned behind the peak 206 of the ceiling, e.g., the evaporator 280 may be closer than the peak 206 to the rear side 146 of the food storage chamber 122 and/or the rear side 110 of the cabinet 120 along the transverse direction T. In such embodiments, the air flow path for chilled air C to the storage element 220 may originate at the evaporator 280, enter the food storage chamber 122 through the vent 284, and continue forward along the ceiling 200, upwards to the peak 206 and downward from the peak 206 to or towards the storage element 220.

In some embodiments, the ceiling 200 of the food storage chamber 122 may include a back portion 214 and the front portion 212. In such embodiments, the back portion 214 of the ceiling 200 may extend from the back side 146 of the food storage chamber 122 and/or from the back edge 204 of the ceiling to the peak 206 of the ceiling 200. Also in such embodiments, the front portion 212 of the ceiling 200 may extend from the peak 206 of the ceiling 200 to the front side 144 of the food storage chamber 122, such as to the front edge 202 of the ceiling 200. For example, the back portion 214 may extend upward from the back side 146 of the food storage chamber 122 to the peak 206 of the ceiling 200 at an angle oblique to the transverse direction T. In some embodiments, the back portion 214 of the ceiling 200 may be oriented at an angle of between about 5° and about 30°, such as between about 10° and about 20°, such as about 15°, above the transverse direction T from the back edge 204 to the peak 206. In some embodiments, the front portion 212 of the ceiling 200 may extend downward from the peak 206 of the ceiling 200 to the front edge 202 of the ceiling 200 at an angle oblique to the transverse direction T. In some embodiments, the front portion 212 of the ceiling 200 may be oriented at an angle of between about 1° and about 20°, such as between about 5° and about 15°, such as about 10°, below the transverse direction T from the peak 206 to the front edge 202.

In some embodiments, the refrigerator appliance 100 may include a light fixture 210. For example, the light fixture 210 may be positioned in the front portion 212 of the ceiling 200. The light fixture 210 may be flush with the ceiling 200, e.g., an external surface 211 (FIG. 6) of the light fixture 210 may be mounted flush with the ceiling 200, such as flush with the front portion 212 of the ceiling 200, such that the external surface 211 of the light fixture 210 defines a portion of the air flow path for chilled air C to the storage element 220.

The front portion 212 of the ceiling 200 may be measured from the front edge 202 of the ceiling 200 going backwards (e.g., towards rear side 146 or rear side 110) and/or inwards (e.g., into the food storage chamber 122). In some embodiments, the front portion 212 of the ceiling 200 of the food storage chamber 122 may be up to one half of the ceiling 200 of the food storage chamber 122, such as up to the front half (measured from the front edge 202 as noted) of the ceiling 200. For example, the front portion 212 may be a front one third or a front one quarter of the ceiling 200.

The present disclosure may provide several advantages. For example, the upper boundary of the flow path for chilled air C defined by the ceiling 200 of the food storage chamber 122 may provide improved, e.g., cleaner, aesthetics, e.g., as described above with respect to FIG. 4. Such configuration may also permit the omission of foamed-in ducts above the ceiling 200, e.g., the refrigerator appliance 100 may not include any air ducts or conduits within the cabinet 120 above the ceiling 200 of the food storage chamber 122, which may permit an increased internal volume, e.g., increased volume of the food storage chamber 122 in proportion to the overall volume of the cabinet 120, of the refrigerator appliance 100.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance defining a vertical direction, a lateral direction, and a transverse direction, the vertical, lateral, and transverse directions being mutually perpendicular, the refrigerator appliance comprising:

a cabinet defining a food storage chamber, the food storage chamber extending between a front side and a back side along the transverse direction and extending between a floor and a ceiling along the vertical direction, wherein the front side of the food storage chamber defines an opening for receipt of food items;

a door positioned at the front side of the food storage chamber and movable between a closed position and an open position to selectively sealingly enclose the food storage chamber in the closed position and provide access to the food storage chamber through the opening in the open position; and a storage element mounted on an interior surface of the door whereby the storage element is positioned at the front side of the food storage chamber when the door is in the closed position, wherein the ceiling of the food storage chamber comprises a front portion and a back portion, the back portion of the ceiling extending upward from the back side of the food storage chamber to a peak of the ceiling at an oblique angle above the transverse direction and the front portion of the ceiling of the food storage chamber extending from the peak of the ceiling to the front side of the food storage chamber, the front portion of the ceiling is-angled downward towards the storage element at an oblique angle below the transverse direction, wherein the front portion of the ceiling of the food storage chamber comprises up to one half of the ceiling of the food storage chamber, whereby the ceiling of the food storage chamber at least partially defines an air flow path for chilled air to the storage element.

2. The refrigerator appliance of claim 1, further comprising a sealed cooling system, wherein an evaporator of the sealed cooling system is positioned at the back side of the food storage chamber and upstream of a vent, whereby the air flow path for chilled air to the storage element originates at the evaporator and enters the food storage chamber through the vent.

3. The refrigerator appliance of claim 2, wherein the vent is oriented towards the ceiling at an oblique angle to the vertical direction.

4. The refrigerator appliance of claim 1, wherein the front portion of the ceiling begins at the peak of the ceiling and the front portion of the ceiling extends frontward and downward from the peak of the ceiling.

5. The refrigerator appliance of claim 1, further comprising a sealed cooling system, wherein an evaporator of the sealed cooling system is positioned behind the peak of the ceiling and upstream of a vent, whereby the air flow path for chilled air to the storage element originates at the evaporator and enters the food storage chamber through the vent.

6. The refrigerator appliance of claim 1, further comprising a light fixture positioned in the front portion of the ceiling, an external surface of the light fixture mounted flush with the front portion of the ceiling, whereby the external surface of the light fixture defines a portion of the air flow path for chilled air to the storage element.

7. A refrigerator appliance defining a vertical direction, a lateral direction, and a transverse direction, the vertical, lateral, and transverse directions being mutually perpendicular, the refrigerator appliance comprising:

a cabinet defining a food storage chamber, the food storage chamber extending between a front side and a back side along the transverse direction and between a floor and a ceiling along the vertical direction, wherein the front side of the food storage chamber defines an opening for receipt of food items;

a door positioned at the front side of the food storage chamber and movable between a closed position and an open position to selectively sealingly enclose the food storage chamber in the closed position and provide access to the food storage chamber through the opening in the open position; and a storage element mounted on an interior surface of the door whereby the storage element is positioned at the front side of the food storage chamber when the door is in the closed position, wherein the ceiling of the food storage chamber comprises a back portion, the back portion of the ceiling of the food storage chamber extending from the back side of the food storage chamber to a peak of the ceiling, wherein the back portion of the ceiling of the food storage chamber comprises at least one half of the ceiling of the food storage chamber, whereby the ceiling of the food storage chamber at least partially defines an air flow path for chilled air to the storage element.

8. The refrigerator appliance of claim 7, further comprising a sealed cooling system, wherein an evaporator of the sealed cooling system is positioned at the back side of the food storage chamber and upstream of a vent, whereby the air flow path for chilled air to the storage element originates at the evaporator and enters the food storage chamber through the vent.

9. The refrigerator appliance of claim 8, wherein the vent is oriented towards the ceiling at an angle oblique to the vertical direction.

10. The refrigerator appliance of claim 7, further comprising a front portion of the ceiling of the food storage chamber, wherein the back portion of the ceiling extends upward from the back side of the food storage chamber to a peak of the ceiling at an angle oblique to the transverse direction, wherein the front portion of the ceiling begins at the peak of the ceiling and the front portion of the ceiling extends frontward and downward from the peak of the ceiling.

11. The refrigerator appliance of claim 10, further comprising a sealed cooling system, wherein an evaporator of the sealed cooling system is positioned behind the peak of the ceiling and upstream of a vent, whereby the air flow path for chilled air to the storage element originates at the evaporator and enters the food storage chamber through the vent.

12. The refrigerator appliance of claim 7, wherein the back portion of the ceiling extends upward from the back side of the food storage chamber to the peak of the ceiling at an angle oblique to the transverse direction.

13. The refrigerator appliance of claim 7, further comprising a front portion of the ceiling and a light fixture positioned in the front portion of the ceiling, an external surface of the light fixture mounted flush with the front portion of the ceiling, whereby the external surface of the light fixture defines a portion of the air flow path for chilled air to the storage element.

14. A refrigerator appliance defining a vertical direction, a lateral direction, and a transverse direction, the vertical, lateral, and transverse directions being mutually perpendicular, the refrigerator appliance comprising:

a cabinet defining a food storage chamber, the food storage chamber extending between a front side and a back side along the transverse direction and extending between a floor and a ceiling along the vertical direction, wherein the front side of the food storage chamber defines an opening for receipt of food items;

a door positioned at the front side of the food storage chamber and movable between a closed position and an open position to selectively sealingly enclose the food storage chamber in the closed position and provide access to the food storage chamber through the opening in the open position;

a storage element mounted on an interior surface of the door whereby the storage element is positioned at the front side of the food storage chamber when the door is in the closed position, wherein the ceiling of the food storage chamber comprises a front portion, the front portion of the ceiling extending downward at an angle oblique to the transverse direction from a peak of the ceiling towards the storage element, wherein the front portion of the ceiling of the food storage chamber comprises up to one half of the ceiling of the food storage chamber, whereby the ceiling of the food storage chamber at least partially defines an air flow path for chilled air to the storage element;

a light fixture positioned above the front portion of the ceiling of the food storage chamber, an external surface of the light fixture mounted flush with the front portion of the ceiling, whereby the external surface of the light fixture at least partially defines the air flow path for chilled air to the storage element.

15. The refrigerator appliance of claim 14, wherein the ceiling of the food storage chamber consists of a back portion and the front portion.

16. The refrigerator appliance of claim 15, wherein the back portion of the ceiling extends upward from the back side of the food storage chamber to the peak of the ceiling at an angle oblique to the transverse direction, wherein the front portion of the ceiling begins at the peak of the ceiling and the front portion of the ceiling extends frontward and downward from the peak of the ceiling.

17. The refrigerator appliance of claim 14, further comprising a sealed cooling system, wherein an evaporator of the sealed cooling system is positioned at the back side of the food storage chamber and upstream of a vent, whereby the air flow path for chilled air to the storage element originates at the evaporator and enters the food storage chamber through the vent.

* * * * *